United States Patent [19]

Leroy

[11] Patent Number: 4,654,129

[45] Date of Patent: Mar. 31, 1987

[54] PROCESS FOR ACCURATELY MAINTAINING A LOW ALUMINA CONTENT IN AN ELECTROLYTIC SMELTING CELL FOR THE PRODUCTION OF ALUMINUM

[75] Inventor: Michel Leroy, Saint-Jean-de-Maurienne, France

[73] Assignee: Aluminium Pechiney, Paris, France

[21] Appl. No.: 859,907

[22] Filed: May 5, 1986

[30] Foreign Application Priority Data

May 7, 1985 [FR] France ..... 85 07319

[51] Int. Cl.[4] ..... C25C 3/06

[52] U.S. Cl. ..... 204/67

[58] Field of Search ..... 204/67

[56] References Cited

U.S. PATENT DOCUMENTS 3,629,079 12/1971 Bristol ..... 204/67

4,431,491 2/1984 Bonny et al. ..... 204/67

*Primary Examiner*—Howard S. Williams

*Attorney, Agent, or Firm*—Dennison, Meserole, Pollack & Scheiner

[57] ABSTRACT

A process is disclosed for accurately maintaining a low alumina content of between 1 and 4.5% in a cell for the production of aluminum by electrolysis in the Hall-Heroult process. According to the invention, a control parameter $P=-1/D(dR_1/dt)$, is determined, wherein D is the variation in the alumina content of the electrolytic bath in % weight per hour, $R_1$ is the internal resistance of the cell, and t is the time. A series of operations is then carried out in a repeated cycle, starting with the cell being fed alumina at a nominal rate which is substantially equal to the quantity consumed by electrolysis. At periodic intervals, an over-supply of alumina is added in order to enrich the bath, and the over-supply is continued for a preset time during which $dR_1dt$ is negative. The feed rate is then reduced to less than the nominal feed rate, during which time $dR_1dt$ passes through zero to become positive and the regulation parameter P, the value of which tends to rise, is measured often. The successive values of P are compared with a required preset value Po. As soon as P equals Po, the feed rate is returned to the nominal feed rate and a new cycle is recommenced.

7 Claims, No Drawings

PROCESS FOR ACCURATELY MAINTAINING A LOW ALUMINA CONTENT IN AN ELECTROLYTIC SMELTING CELL FOR THE PRODUCTION OF ALUMINUM

OBJECT OF THE INVENTION

The present invention relates to a process for accurately maintaining a low alumina content in an electrolytic smelting cell for the production of aluminum by the Hall-Heroult process, the purpose of such regulation also being to maintain the Faraday efficiency at a high level, at least equal to 94%.

SUMMARY OF PRIOR ART

Over recent years, the operation of cells for the production of aluminum has been increasingly automated, both in order to improve energy efficiency and regularity of operation and to limit human intervention and improve efficiency of recovery of effluence containing fluorine.

One of the essential factors in obtaining the regular operation of a cell for the production of aluminum by electrolysis of alumina dissolved in molten cryolite, is the rate at which the alumina is supplied to the bath. A deficiency in alumina results in the appearance of the "anodic effect", or "packing" which means a sudden increase in the voltage at the terminals of the cell, which can rise from 4–30 or 40 volts, and which has an effect on the whole pot line.

An excess of alumina creates a risk of contamination of the bottom of the cell by deposits of alumina which can be transformed into hard-plates which electrically insulate a part of the cathode. This induces in the liquid aluminum deposit strong local horizontal currents which, by inter-action with magnetic fields, stir up the liquid aluminum deposit and cause an instability in the bath-metal interface, as well as other problems well known to the engineer.

This problem is particularly troublesome when we want to lower the operating temperature of the cell, which is very favourable for its service life and for the Faraday efficiency value, by using very "acid" (high $AlF_3$ content) baths and/or baths containing various additives, such as chlorides, lithium salts, or magnesium salts. These baths, however, have an alumina dissolution capacity and speed which are considerably reduced, and their use implies very precise control of the alumina content to concentrations which are relatively low and within two extremely close limits.

Although it is possible to directly measure the alumina content of the baths by analysis of samples of electrolysis, for many years the preferred method has been to make an indirect determination of alumina contents by observing an electric parameter reflecting the concentration in alumina of the said electrolyte.

This parameter is generally the variation in internal resistance, or, more precisely, internal pseudo-resistance which is equal to:

$$R_j=(U-E_0)/J$$

Where $E_o$ represents the counter-electro-motive force of the cell, the value of which is generally accepted to be 1.65 volts, U represents the voltage at the terminals of the cell, and J the current passing through the cell.

By testing, a variation curve $R_i$ can be plotted as a function of the alumina content, and by measurement of $R_i$ at a determined frequency using methods well known at present, the concentration symbolised by $[Al_2O_3]$ can be estimated at any given moment.

For many years efforts have been made to introduce the alumina into the baths with precise regularity in order to keep its concentration relatively stable around a preset value.

Processes for automatic alumina feed, operating more or less strictly as a function of its concentration in the bath, have been described in particular in the following patents: French patent FR 1 457 746 of REYNOLDS, in which the variation of the internal resistance of the cell is used as a parameter reflecting the concentration in alumina, the introduction of which into the bath is effected by a distributor combined with a device for piercing the fixed electrolysis crust; French patent FR 1 506 463 of V.A.W., which is based on measurement of the time elapsing between halting the alumina supply and appearance of anodic effect; American patent U.S. Pat. No. 3,400,062 of ALCOA, using a "pilot anode" in order to obtain an early detection of the tendency towards packing and to regulate the alumina feed rate, the alumina being distributed from a hopper which is equipped with a device for piercing through the crust of electrolyte.

More recently, controlled processes based on controlling the alumina content have been described in particular in Japanese patent application JA 52-28417/77 of SHOWA DENKO, and in American patent U.S. Pat. No. 4,126,525 of MITSUBISHI.

In the first of these patents, the alumina concentration is set within the interval 2–8%. The variation $\Delta V$ of the voltage at the terminals of each cell is measured as a function of time t, and compared with a preset value, the alumina feed rate being adjusted in order to bring $\Delta V/t$ to the required value. The disadvantage of this method is that its sensitivity varies with the alumina content, which is precisely minimal within the interval used, from 3–5% $Al_2O_3$ (tables p.8.).

In the second of these patents, the alumina content is set within the range 2–8% and, preferably, between 4–6%. The cell is supplied over a preset time $t_1$ with a quantity of alumina greater than its theoretical consumption rate, until a predetermined alumina concentration (e.g. up to 7%) is obtained, and then the supply is controlled at a rate equal to the theoretical consumption over a predetermined time, $t_2$, after which the supply is halted until the first signs of the anodic effect ("packing") appear, and the supply cycle is restarted at a rate higher than theoretical consumption. With this method, the concentration of alumina varies, during the cycle, between 4.9 and 8% (example 1) or 4.0 and 7% (example 2).

Finally, in our French patent, FR 2 487 386 (Aluminium Pechiney), to which correspond patents EP 44 794 and U.S. Pat. No. 4,431,491, we have described a process for the accurate regulation of the alumina content, to between 1 and 3.5% by weight, a process according to which the alumina supply rate is controlled as a function of variations in the internal resistance of the cell over predetermined intervals of time, alternating alumina feed cycles of equal duration at a slower and faster rate than the rate corresponding to the consumption of the cell.

This process, known as "curve calculation", is based on successive measurements of the internal resistance $R_i$, at equal intervals of time, on evaluation of the curve dRi/dt of variation of $R_i$ as a function of time, and comparison of $R_i$ on the one hand and dRi/dt on the other hand with set values, and on adjusting the alumina feed rate in such a way as to bring dRi/dt and $R_i$ to the required values.

To find an optimum mode of operation, i.e. to determine those operating parameters for electrolytic smelting cells which give the best manufacturing cost, or the highest profit margin for a given investment, has always been a constant concern of the engineer.

In particular, to find the influence of the various operating parameters on the energy efficiency—also termed the Faraday efficiency—has been the object of numerous publications, the most important of which are quoted in the work by K. GRJOTHEIM et al, entitled "ALUMINIUM ELECTROLYSIS": the second edition, the most recent edition, was published in 1982 by Aluminium VERLAG (Düsseldorf, West Germany).

In this work, on page 339, FIG. 9.11, it can be seen that the authors quoted are in agreement in confirming that a rise in bath temperature has an unfavourable effect on output in terms of electrical energy used. Furthermore, the phase diagram for the cryolite-alumina system, shown on page 29, FIG. 2.3 of the same work indicates that the temperature of the liquid of the bath is all the higher the lower the alumina content of this bath.

It would therefore be logical for the Faraday efficiency to be as high as the alumina content of the bath is high. This is, in fact, what many authors have believed to be the case, for industrial cells, as is shown by FIG. 9.20 page 356 of the work cited.

SUMMARY OF PROBLEM

At present, economic and technical conditions for the production of aluminum by the Hall-Heroult process make it necessary for the manufacturer to constantly endeavour to optimise the different factors determining the manufacturing cost of the metal, and amongst these factors the Faraday efficiency is one of the most important, and also one of the most delicate, because slight disturbances can greatly reduce the Faraday value. It is therefore desirable to determine all the factors which influence Faraday efficiency in order to maintain it at a high and stable value.

At the present price of aluminum on the LME ($1,200 per tonne at end of April 1985) 0.1 Faraday on a production of 500,000 tonnes/year corresponds to a gain of close on $380,000/year.

OBJECT OF THE INVENTION

The object of the invention is an improvement in the process for accurately maintaining a low alumina content in an electrolytic smelting cell so as to substantially improve the Faraday efficiency.

In observing the implementation of the process of control by curve calculation, object of our above mentioned patent, in our modern electrolytic smelting cells operating at 175,000 or 280,000 Amps, with an "acid" bath composition, i.e. a bath containing more than 8% by weight of aluminimum fluoride $AlF_3$ in excess in relation to the neutral cryolite of formula $Na_3AlF_6$, we have noted, contrary to the general opinion of the experts cited above, that, in spite of the increase in temperature of the electrolysis bath, the energy efficiency increased rapidly as the alumina content of the bath was lowered.

We have discovered that this phenomenon has a significance hitherto unsuspected since, by reducing the 2.5% by weight alumina content in the bath to 1.5% by weight, this reduction by 1 point in the alumina content permitted a raising of the energy efficiency from 94% to 95.7%, i.e. an increase of 1.7% in the output of electrolysis. And yet, because of the increase in the operating temperature of the electrolysis bath, which at the same time rose from 946° C. to 951° C., logically we should have observed a drop of 1% in this output.

However, this increase in output is accompanied by an increase in the voltage of electrolysis, which is all the more rapid the lower the alumina content.

The energy consumption per tonne of aluminum produced can be expressed as a function of Faraday efficiency F, and of the voltage at the terminals of a cell, U, in the form:

$$Kwh/\text{tonne}=2980\ U(\text{volts})/F$$

Furthermore, at the fixed intensity of electrolysis J, the production of a cell is proportional to its efficiency F, i.e. the influence of "fixed" costs (depreciation, financial costs, and a great part of labour and maintenance costs) is all the lower the better the Faraday efficiency.

Considering the discovery which we have made of the very strong influence of the alumina content of the bath on the Faraday efficiency, it can be understood that there is every interest in regulating the alumina content of the bath to a low value which is, however, sufficient to avoid the energy cost due to the increase in voltage at the terminals of the cell from outbalancing the gains hoped for by improving the Faraday efficiency.

In general, and for normal economic conditions, this optimum alumina content is located very close to the minimum content below which the "anode effect", also termed "packing" or "polarisation", occurs, resulting in a very sudden rise in the voltage at the terminals of the cell and of the temperature of the electrolysis bath, and consequently with large quantities of products containing fluoride being released as a result of the decomposition of the electrolysis bath.

In order to avoid such a phenomenon, disastrous both in its effects on energy performances and on the environment, by coming as close as possible to the alumina content which gives the most efficient economic performances, it can be understood that it is extremely important to have a process making it possible to control and regulate with high precision the alumina content of the electrolysis bath in the low content range, for example, between 1% and 3%, prefereably between 1% and 2.5%.

A prime object of the invention is to provide such a process for the regulation of the alumina content of the bath within the range of low contents, by using a synthetic parameter P which can be calculated simply on the basis of conventional measurements made on an electrolysis cell, i.e. the voltage at the terminals of the cell, the current passing through the cell line, and the alumina feed rate (e.g. in kg/hour).

This parameter P is evaluated on the basis of the internal psuedo-resistance of the cell, $R_i$, itself defined by:

$$R_i - 10^3(U-Eo)/J$$

where U is the voltage at the terminals of the cell (in volts).

Eo is a fixed value, in volts, for the dynamic counter-electro-motive force of the cell, generally between 1.5 and 2.0 volts, more frequently of the order of 1.65 to 1.75 volts.

J is the intensity of electrolysis, expressed in kiloamps ($=10^3$ amps).

$R_i$ is then expressed in micro-ohms.

(Its fluctuation $dR_i/dt$ generally being expressed in micro-ohms per second).

More precisely, if D is the fluctuation in the alumina content of the electrolysis bath, expressed, for example, in percent weight per hour, P is expressed by the formula:

$$P=-1/D(dR_i/dt)$$

(P being expressed in micro-ohms per second and by % weight per hour).

Cell regulation in conformity with the invention is characterised by remaining as long as possible within an alumina content band, which is not necessarily accurately known, but which is such that P is as close as possible to a (a) For this the cell is supplied at a regular rate, called the nominal rate CN, which is such that the quantity of alumina introduced into the bath is more or less equal to the quantity of alumina consumed by electrolysis. During these periods at nominal rate, it is possible to adjust without difficulty the inter-polar distance on the basis of the pseudo-resistance value which is then measured for a bath alumina content which is substantially constant.

(b) Then, on the basis of this stable situation, at set times an increased supply is started, i.e. alumina supply at a rate of C+ greater than nominal rate CN. Under these conditions the bath is gradually enriched in alumina at a rate which is all the faster the greater the rate of increased supply.

The duration t+ of this increased supply is set so as to give an enrichment in alumina of the electrolysis bath. It should be noted that it is not necessary to measure or calculate the precise value of this enrichment. It is possible, during this period of increased supply, to follow the curve of pseudo-resistance of the cell ($=dR_i/dt$). There is, however, a risk that all the alumina introduced into the bath may not be instantaneously dissolved, this risk being all the greater the faster the increased supply rate.

The values of P which are measured are thus affected by a risk of error which is not zero, and, in general, they are only used to detect serious errors in supply.

(c) After this increased supply rate over a set time t+, the supply rate is dropped to below the nominal rate, i.e. the cell is supplied at a rate C− which is slower than the nominal rate corresponding to consumption of alumina by electrolysis. Generally at the start of under-supply it can be observed that the curve ($dR_i/dt$), normally negative during over-supply, takes a certain time to reach nil and then assume higher and higher positive values.

This initial period, which generally only lasts a few minutes, corresponds to the end of dissolution of the excess alumina fed in during the period of over supply and not immediately assimilated by the bath.

This initial period during which the alumina content of the bath does not vary in conformity with the rate of supply of this alumina can be easily neutralised, i.e. by frequent measurements we have observed that the duration of this initial period was about 2–3 times the duration separating the start of the period of undersupply and the moment when the calculated $dR_i/dt$ curve passed through the zero value.

Another method is to insert a period of a few minutes at nominal rate after over supply before going on to under supply.

After this initial period, the alumina content of the bath decreases all the more rapidly the slower the feed rate, and, in parallel, the measured curve $dR_i/dt$ rises.

The fluctuation in alumina content, D, calculated in percent weight per hour, is then proportional to:

$$D=-\left(1-\frac{C^-}{C_N}\right)\left(\frac{Q\ Al_2O_3}{Q\ \text{liquid bath}}\right)$$

where $C^-$ is the under-supply rate calculated in kg of $Al_2O_3$ fed per second and $C_N$ is the nominal feed rate (calculated in the same units). Any other coherent system of units can naturally be used, for example, the inverse of the time separating the introduction of two successive batches of alumina.

$Q(Al_2O_3)$ is the weight of alumina consumed per unit of time by electrolysis.

Q (liquid bath) is the weight of liquid bath capable of dissolving the alumina and contained in the pot (by way of example, if the liquid bath weight is measured in kg, around 30 J, J being the current of electrolysis measured in kA). It should be noted that the time constant for the melting or solidification of the bath at the level of the slope being very high (generally several hours), this quantity only varies very slowly with time.

For example, for a 280 kA cell containing 8000 kg liquid bath and consuming 170 kg alumina per hour, and a rate $C-=0.7$ CN we obtain $D=-0.64\%$ per hour.

It is therefore possible to measure the synthetic parameter $P=-1/D\cdot(dR_i/dt)$ reliably and frequently.

(d) As the period of under-supply continues, the value of P, initially lower than the set value Po, increases and finally reaches this set value. This event takes place after a t− of under-supply which cannot be predetermined with certainty and which generally differs from the time t+ of over-supply.

(e) We then return to nominal rate CN, i.e. a feed rate equal to the rate of consumption of alumina by electrolysis, for a time $t_N$ at the end of wich the measurement and control cycle restarts as described in paragraph (a) above.

The alumina content aimed at being close to the critical content resulting in polarisation of the cell, it is essential that after operation at nominal rate, before the phase of location of operating point (characterised by Po) is started, during a period of under-supply, a period of over-supply is inserted, making it possible to move away from this critical content limit.

Of course, the control process according to the invention can only be used during part of the operating time of the cell, and preferably when the cell is stable.

In fact some operations disturb normal operation, and this is particularly the case with operations involving changing of anodes and casting of the metal produced.

It will be obvious to the expert that specific regulation algorithms can be adopted during and after the carrying out of these disturbing operations until the cell has re-established sufficient stability of operation.

It will also be clear to the expert that between the over-supply stage (3) and the controlled under-supply stage (4) we can insert a supplementary phase of normal feed rate—or of slight over- or under-supply—without this significantly interfering with the process according to the invention, i.e. this does not prevent location of the operating point such that $P=-1/D(dR_i/dt)$ is close to Po.

With respect to the estimation of the value of Po corresponding to cell operation coming closest to the economic optimum, it has appeared to us that Po may be described by a very simplified equation:

$$Po=K_1 \cdot K_2/J$$

where: Po is expressed in micro-ohms per second and by percent weight per hour.

$K_1$ is an "economic" coefficient synthesising economic conditions at a given time (in particular energy cost compared with other factors in the manufacturing cost, except the alumina).

$K_2$ is a "technical" coefficient synthesising the physiochemical and technological characteristics of the cell ($K_2$ is practically independent of $K_1$).

J is the current operation of the cell, expressed in kilo-amps ($=10^3$ amps).

Preferably this parameter Po is kept within the limit values of 2/100 J and 10/100 J.

$K_1$ and $K_2$ can be calculated as follows:

Economic coefficient $K_1$ synthesises current economic conditions. It is substantially equal to the ratio of the sum of fixed transformation costs (excluding alumina), including in particular the cost of energy and consumable carbonaceous products, of labour and depreciations, including financial costs, to the cost of the energy.

As an illustrative and non-exclusive example, a good approximation of this coefficient $K_1$ can be obtained by breaking down as follows the production costs for 1 tonne of aluminum:

A=cost of alumina and various raw materials (excluding carbon).

C=cost of carbonaceous raw materials.

E=cost of energy (electrolysis and collection).

P=other production costs (mainly labour and maintenance costs).

AFF=depreciations and financial costs.

We thus express $K_1$ as being approximately equal to:

$$K_1=C+E+P+AFF/E$$

(an estimate of $K_1$ at ±20% is largely sufficient in order to sufficiently approach the economic optimum).

As an example, for an aluminum production cost broken down into:

A=4000FF/Tonne (FF=French Francs)

C=1000FF/Tonne

E=2000FF/Tonne

P=2000FF/Tonne

AFF=1200FF/Tonne we obtain:

$K_1=1000+2000+2000+1200/2000-6200/2000\ 3.10$

The "technical" coefficient $K_2$ synthesises the physiochemical and technological characteristics of the cell and can be calculated as follows:

Experimentally, as an initial approximation (generally sufficient to determine an adequately optimised operation of the cells) we obtain:

$$K_2=-(1/360)\times(U/F)\times(dF/d(Al_2O_3))$$

where: U is the voltage at the terminals of the cell, in volts, generally between 3.8 and 5.5 volts for cells correctly operated by qualified engineers.

F is the Faraday efficiency of the cell, generally betwee 0.88 and 0.96 for the same correctly operated cells, $dF/d(Al_2O_3)$ is the algebraic drift of the Faraday efficiency in relation to the alumina content of the bath, calculated in % Faraday per % alumina, within the band of alumina contents between 1% and 4%, and preferably within the band of contents of $Al_2O_3$ between 1.5% and 3%.

This factor $dF/d(Al_2O_3)$ depends on many factors such as the composition of the bath (acidity=excess of $AlF_3$), its overheating (e.g. the difference between the effective bath temperature and its initial solidification temperature), the magnetic equilibrium (and in particular the stirring and deformation of the bath/metal interface).

In general, this factor $dF/d(Al_2O_3)$ must be experimentally determined for each type of cell and for the different types of baths used (slightly acid baths, with less than 8% excess $AlF_3$ or very acid baths over 8% excess of $AlF_3$ or with sub-additives such as LiF and $MgF_2$). Once determined, it no longer depends for the purposes of a rough approximation on economic conditions.

As a non-limitative example, for a cell of nominal current 280 kA, operating with a bath with 13% excess $AlF_3$ and less than 1% LiF, with a bath temperature of approximately 950° C. and an alumina content of between 1.7% and 2.5%, we have found:

$$(dF/dAl_2O_3)=-1.5\ (\%\ \text{Faraday per}\ \%\ \text{alumina})$$

(i.e. the Faraday efficiency increases by 10.5% when the alumina content is reduced by 1%).

For the same cell under the same conditions of operation, we have measured:

F=0.95 (i.e. 95%)

V=4.10 volts

We deduce from this the technical coefficient $K_2$ for this type of cell operating with an acid bath as follows:

$$K_2=-(1/360)\times(4.1/0.95)\times(-1.5)=+1.8/100.$$

EXAMPLE OF APPLICATION

The invention has been applied for a line of electrolysis cells functioning at a current of 280 kA, and a voltage of 4.10 V per cell and giving a Faraday efficiency of 95.0% for a mean alumina content of the electrolysis bath equal to 2.3% controlled according to the process of our patent FR 2 487 386 already quoted (process termed "curve calculation process").

The diary production of the line, per cell, was 2,145 kg/day, for an energy consumption of 12,860 kWh/tonne.

We determined the parameter Po taking for:

$K_1$ the value of: 3.10

$K_2$ the value of: +1.8/100

(J nominal being equal to 280 kA)

where $Po=+200.10^{-6}$ (micro-ohms per second, per % per hour) (corresponding to 5.6/100 J).

Having selected an under-supply rate $C^-$ equal to 70% of the nominal rate CN, corresponding to a fluctuation of alumina content D=−0.64% per hour, we then obtained according to the location method described above, the operating point at which $dRi/dt = -Po \times D = +130.10^{-6}$ micro-ohm/second at the moment when nominal rate $C_N$ was started.

We obtained the following results:

| Parameters | | Comparisons with prior art |
|---|---|---|
| Equilibrium current J | 281 KA | (+0.3%) |
| Voltage | 4.15 volts | (+1.2%) |
| Faraday efficiency | 95.7% | (+0.7%) |
| Energy consumption | 12 920 kWh/T | (+0.5%) |
| Daily production | 2 167 kg/day | (+1.0%) |
| Mean observed alumina content of bath | 1.9% | |

The gain in terms of manufacturing cost (depreciations and financial costs included) was 20FF per tonne of aluminum produced.

What is claimed is:

1. Process for accurately maintaining a low alumina content of between 1 and 4.5% in a cell for the production of aluminum by electrolysis, by the Hall-Heroult process, comprising, in order to obtain a Faraday efficiency at least equal to 94%, determining a regulation parameter $P = -1/D \cdot (dR_1/dt)$, expressed in micro-ohms per second and percent weight per hour, where D is the fluctuation in the alumina content of the electrolytic bath, expressed in % by weight per hour, $R_1$ is the internal resistance of the cell, and t is the time and comprising carrying out the following operations in a repeated cycle:

(a) feeding the cell alumina at a nominal rate CN such that the quantity of alumina supplied to the bath is substantially equal to the quantity consumed by electrolysis;

(b) adding at periodic intervals, an over-supply of alumina at a rate C+, greater than the nominal rate CN, in order to enrich the alumina bath and continuing the over-supply for a preset time t+, during which period $dR_1/dt$ is negative;

(c) reducing the feed rate to a rate C−, less than the nominal feed rate CN, and as the curve $dR_1/dt$ passes through zero to become positive, measuring the regulation parameter P, the value of which tends to rise, often;

(d) comparing the successive values of P with a required preset value Po, and as soon as P=Po, returning the feed rate to nominal feed rate CN, and recommencing a new cycle at step (a).

2. Process according to claim 1, wherein after step (b) of over-supply, a phase of normal supply CN is maintained for a few minutes before reducing the rate to C−.

3. Process according to claim 1, wherein after step (b) of over-supply, a rate approximating the nominal rate CN is maintained for a few minutes.

4. Process according to claim 1, wherein the set value Po of the regulation parameter P is determined on the basis of the current J in kA of the electrolysis current, and of coefficients $K_1$ and $K_2$, wherein $K_1$ is related to production costs and $K_2$ is related to the physiochemical charcteristics of the cell according to the relationship $Po = K_1K_2/J$.

5. Process according to claim 4, wherein coefficient $K_1$ is substantially equal to the ratio of the fixed transformation costs, energy, consumable carbonaceous products, labor, and depreciations, to the cost of electric energy.

6. Process according to claim 4, wherein coefficient $K_2$ is substantially equal to:

$$-1/360 \times \frac{U}{F} \times \frac{dF}{d\,(Al_2O_3)},$$

wherein U is the voltage at the terminals of cell, and F is the Faraday efficiency.

7. Process according to claim 1, 2, 3 or 4, wherein the required value Po of the regulation parameter P expressed in micro-ohms per second and percent weight per hour is fixed between 2/100.J and 10/100.J, wherein J is the electrolysis current expressed in kA.

* * * * *